US009045877B2

(12) United States Patent
Martigli

(10) Patent No.: US 9,045,877 B2
(45) Date of Patent: Jun. 2, 2015

(54) ASSEMBLABLE DISPOSABLE SHUTTERING FOR CONSTRUCTING MODULAR FORMWORKS FOR MAKING CONCRETE FOUNDATIONS

(76) Inventors: Massimo Martigli, Capraia E Limite (IT); Fabrizio Martigli, legal representative, Florence (IT); Maddalena Martigli, legal representative, Florence (IT); Monica Serafini, legal representative, Florence (IT)

( * ) Notice: Subject to any disclaimer, the term of this patent is extended or adjusted under 35 U.S.C. 154(b) by 0 days.

(21) Appl. No.: 13/879,640

(22) PCT Filed: May 13, 2011

(86) PCT No.: PCT/IT2011/000149

§ 371 (c)(1),
(2), (4) Date: Apr. 30, 2013

(87) PCT Pub. No.: WO2012/053021

PCT Pub. Date: Apr. 26, 2012

(65) Prior Publication Data

US 2013/0212965 A1 Aug. 22, 2013

(30) Foreign Application Priority Data

Oct. 20, 2010 (IT) ..... FI2010A0214

(51) Int. Cl.

| | |
|---|---|
| ***E02D 27/32*** | (2006.01) |
| ***E04C 3/00*** | (2006.01) |
| ***E04B 2/00*** | (2006.01) |

(Continued)

(52) U.S. Cl.

CPC ..... *E02D 27/013* (2013.01); *E04G 13/00* (2013.01); *E04B 1/167* (2013.01)

(58) Field of Classification Search

CPC ... E04B 2/8635; E04B 2/8611; E04B 2/8623; E04B 1/167; E02D 27/013; E04G 13/00

USPC ..... 52/79.1, 292, 294, 299, 427, 576, 581, 52/526, 479, 481.1, 286, 588.1, 480, 52/481.2, 483.1, 762, 763

See application file for complete search history.

(56) References Cited

U.S. PATENT DOCUMENTS 1,224,277 A * 5/1917 Clarke ..... 428/585
3,367,063 A * 2/1968 Bondesen et al. ..... 446/119

(Continued)

FOREIGN PATENT DOCUMENTS

DE 29902204 U1 12/1999
DE 102004013017 A1 10/2005

(Continued)

OTHER PUBLICATIONS

International Search Report issued in corresponding International Patent Application No. PCT/IT2011/000149 dated Aug. 29, 2011 (5 pages).

*Primary Examiner* — Phi A
*Assistant Examiner* — Omar Hijaz
(74) *Attorney, Agent, or Firm* — Kilyk & Bowersox, P.L.L.C.

(57) ABSTRACT

Assemblable disposable shuttering, for constructing modular formworks suitable for making foundations, said shuttering substantially configured as the lateral surface of a parallelepiped, having on the lateral faces a plurality of openings suitable toe release, during the filling casting, a part of the cement mixture into the foundation trench.

7 Claims, 3 Drawing Sheets

(51) Int. Cl.

| | |
|---|---|
| ***E04C 2/34*** | (2006.01) |
| ***E02D 27/01*** | (2006.01) |
| ***E04B 1/16*** | (2006.01) |
| *E04G 13/00* | (2006.01) |

(56) References Cited

U.S. PATENT DOCUMENTS

| | | | | |
|---|---|---|---|---|
| 3,417,533 | A | 12/1968 | Sparling | |
| 4,071,996 | A * | 2/1978 | Muto et al. | 52/745.21 |
| 4,358,084 | A * | 11/1982 | Bowman | 249/82 |
| 5,402,608 | A * | 4/1995 | Chu | 52/79.1 |
| 5,473,850 | A * | 12/1995 | Balding | 52/426 |
| 5,528,876 | A * | 6/1996 | Lu | 52/654.1 |
| 5,542,219 | A * | 8/1996 | Dias | 52/126.4 |
| 6,167,672 | B1 * | 1/2001 | Okitomo | 52/834 |
| 6,295,770 | B1 * | 10/2001 | Sheu et al. | 52/167.1 |
| 7,596,909 | B1 | 10/2009 | Gillen | |
| 7,607,274 | B1 * | 10/2009 | Gillen | 52/745.02 |
| 7,665,259 | B2 * | 2/2010 | Yoon et al. | 52/423 |
| 7,987,638 | B1 * | 8/2011 | Fang | 52/167.1 |
| 8,181,415 | B2 * | 5/2012 | Mancine | 52/570 |
| 2004/0020145 | A1 * | 2/2004 | Matsufuji | 52/223.7 |
| 2004/0045241 | A1 * | 3/2004 | Guillebeau | 52/378 |
| 2008/0098687 | A1 * | 5/2008 | Marsh et al. | 52/606 |
| 2010/0229487 | A1 * | 9/2010 | Lewis | 52/408 |
| 2011/0030298 | A1 * | 2/2011 | Paul et al. | 52/294 |

FOREIGN PATENT DOCUMENTS

| | | | |
|---|---|---|---|
| FR | 1411572 | A | 9/1965 |
| JP | 11-343628 | A | 12/1999 |
| WO | 88/05104 | A1 | 7/1988 |

* cited by examiner

ASSEMBLABLE DISPOSABLE SHUTTERING FOR CONSTRUCTING MODULAR FORMWORKS FOR MAKING CONCRETE FOUNDATIONS

This application is a National Stage Application of PCT/IT2011/000149, filed May 13, 2011, which claims priority to Italian Patent Application No. FI2010A000214, filed Oct. 20, 2010.

FIELD OF APPLICATION

The present invention regards an assemblable disposable shuttering for constructing modular form-works for holding and modelling shallow concrete foundation castings.

PRIOR ART

In the field of civil construction there are various types of shallow foundations, i.e. foundations which transfer the weight of the building to the ground for direct contact; the various types of foundations are used depending on the characteristics of the ground and of the type of construction. There are isolated plinth, ground beam, strip foundations while the piles and/micropiles are usually intended for deep foundations.

The invention subject of the present patent application finds the main application thereof in the field of ground beam foundations; these structures are frequently used for shallow foundations, particularly indicated in cases where there are problems related to differential settlement.

The ground beams are usually made of concrete, generally in form of long parallelepipeds underlying the walls.

Concrete is often reinforced using iron rods, preferably of the improved adherence type.

The thickness of the ground beam is basically related to the amount of shear stresses, while the width is correlated to the bearing capacity of the ground and to the amount of loads coming from the elevated structure.

In order to meet the design heights, the foundation ground beam is usually provided over an oversite concrete, which consists of a horizontal layer of concrete, generally without a metal reinforcement, unless in particular cases, with low cement content, called lean concrete positioned at the trench height, established by the designer.

In the reinforced concrete construction process the foundation beam is provided by preparing a formwork, generally wooden, at times metallic, by providing a longitudinal reinforcement made of structural steel rods, both at the top strip and at the bottom strip, with the function of supporting the flexure actions.

Such bars are arranged at suitable positions, with respect to the concrete cover.

The longitudinal reinforcement is then reintegrated by brackets. The arrangement thereof complies with the general provisions according to the "tensile" fibres search. Hence, for a beam "fixed" at the ends, the reinforcements shall be in proximity to the top strip of the centreline section and in proximity to the bottom strip at the fixed end.

Generally, particularly for the seismic areas, the foundation beams of any structure are warped in the two directions and, together, they form the so-called foundation grillage.

Only when the beams are too close, in order to reduce the structural expenses, it is preferred to provide a single casting, which is extended over the entire laying surface, called foundation slab, or even bed.

The concrete casting technique has been known over time and it generally provides for the use of a formwork, which has the aim of holding concrete until it hardens enough and thus acquires structural resistance characteristics.

The formworks may be divided into two main categories: reusable formworks, which are generally constituted by flat panels made of wood or metal or any other suitable material and disposable form-works. A formwork is referred to as a disposable formwork when material is cast into a formwork and the latter is not then removed but remains integral with the hardened cement.

In the building industry, there are two examples of structures obtained using disposable formworks, among which various types of bearing piles and bearing walls; further known are modular elements, called shutterings, each having dimensions substantially smaller than those of the product to be made and such shutterings being composed to obtain formworks of the required dimensions.

Both patent EP0256959 and DE 3436690 are examples of modular disposable shutterings, for ground beam foundations for levelled bedding layer.

These disposable modular shutterings are generally made in such a manner to be assembled together leaving passages from one shuttering to the other inside them.

Said passages allow the cement mixture to spread among the adjacent shutterings, so as to allow an efficient pouring of the concrete into the formworks.

Said passages are also required for the laying of the reinforcement irons.

However, these solutions are uncomfortable to use in that they require transporting large elements, while, for example EP0935028 shows a disposable shuttering that may be stacked to reduce overall dimensions during transport.

Disposable shutterings not made in a single piece, but intended to be mounted on site before being suitably arranged on the oversite concrete to provide formworks intended to receive and confer a shape to the foundation casting, were devised in order to overcome this drawback; an example of this type of disposable shuttering is provided in GB2240350A.

Shutterings of the type described up to now are however expensive to implement, given that they require prior preparation of the oversite concrete.

OBJECTS AND SUMMARY OF THE INVENTION

Thus, the main object of the present invention is that of providing a modular shuttering, that is easy to use and inexpensive to make, capable of allowing obtaining formworks for reinforced concrete ground beam foundations, of desired shapes and dimensions, also allowing an easy positioning of the reinforcement irons and the passage of the cement mixture between the shutterings and the partial outlet of the concrete up to the filling of the trench, without requiring laying a preliminary oversite concrete, thus allowing considerable reduction of costs and execution times.

Furthermore, the disposable shuttering subject of the present invention, allows quickly obtaining the formworks which have the purpose of holding and arranging the reinforcement rods as well as conferring to the casting the desired geometric shape and dimensions.

Another object of the present invention is that of providing disposable shutterings that may be assembled—on site, slightly before laying in the trenches thereof to obtain the formwork, hence reducing the space required in the means of transport.

From another point of view a further advantage of the present invention lies in providing formworks provided with a top profile having means for connecting the walls in elevation.

This, and other objects and advantages, that shall be clear to those skilled in the art after reading the text that follows, are substantially obtained using a modular framework obtained by using a plurality of disposable shutterings.

The single disposable shuttering, preferably obtained made of plastic material, is configured as the surface of a parallelepiped, in said surface, there are two lateral faces, a top face and a bottom face; and two coupling faces, opposite with respect to each other, intended to be coupled to coupling faces of other identical shutterings.

In all types of shutterings subject of the present invention, the lateral faces and the top and bottom faces have perforations, while the coupling faces are substantially entirely open.

Due to this embodiment the concrete may drop from the top towards the bottom and progressively fill all the shutterings that form the formwork; in order to facilitate the progressive filling of the entire formwork each of the at least two coupling faces of each shuttering have at least one hole to allow the cement mixture to flow even horizontally and not only vertically.

The external lateral faces have a plurality of holes from which, during casting, the cement mixture exits, ending up filling the entire trench.

After the shutterings are arranged to form the modular formwork and before the concrete casting starts, the improved adherence iron rods, brackets, and possible pipes for the discharge passages, as well as cable ducts for the electric system, may be laid in the formwork.

In order to avoid using the oversite concrete the shutterings subject of the present invention must be preliminarily aligned; the shuttering being provided with the positioning height definition means for this purpose.

In a preferred embodiment of the invention said means for defining the height are constituted by a nut rigidly connected to the shuttering and by a screw cooperating with said nut.

In order to make the production and transport of the shutterings easier and less expensive, the shutterings may be obtained by assembling—on site—different pieces together, by means of suitable connection means; otherwise, the shutterings may be obtained by assembling a smaller number of pieces provided with laminar hinges or other means for facilitating folding and connection thereof.

In a particularly advantageous embodiment, the present invention also allows transporting the shutterings to the worksite in a particularly inexpensive and convenient manner, occupying little space for transport with respect to the overall volume of the finished formworks.

This result is obtained by making each disposable shuttering as one or more moulded elements made of plastic material, each element being substantially flat-shaped, comprising one or more of the various faces of the lateral surface.

In particular, the shuttering subject of the present invention may be obtained from a flat-moulded element, comprising the four faces of the lateral surface of the parallelepiped, aligned and arranged two by two, connected to each other by laminar hinges obtained during the moulding.

At the worksite the different disposable shutterings are first assembled and then they are joined to other shutterings to obtain the formwork.

It should be observed that, as previously mentioned, in order to reduce the dimensions of the pieces to be moulded, the present invention may be obtained by moulding smaller pieces to be joined together through suitable connection means. By way of non-limiting example it is indicated that said connection means may be constituted by self-tapping metal screws and, bolts made of plastic material, hooks, clamps, brackets, etc.

The advantages and the technical characteristics shall be clear from the detailed description of an embodiment, provided by way of non-limiting example, that follows.

DETAILED DESCRIPTION OF AN EMBODIMENT OF THE INVENTION

Figure 1:
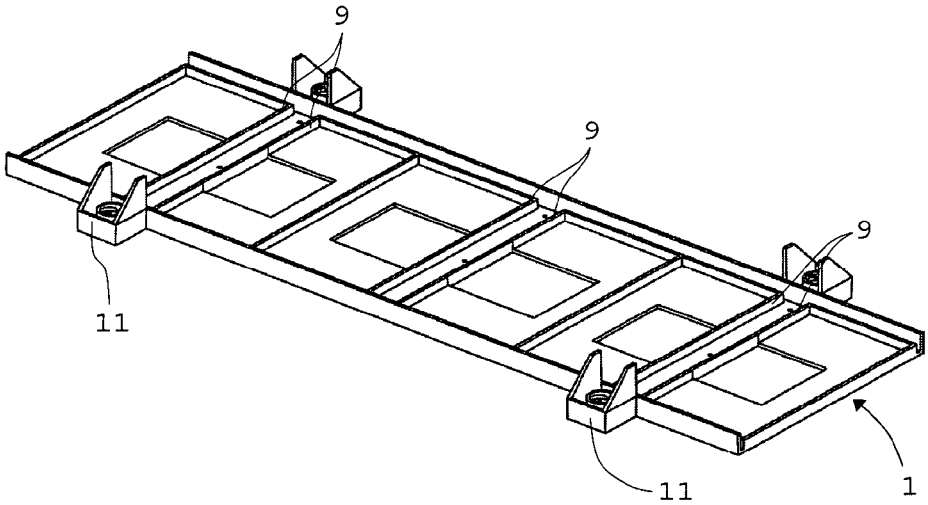
FIG. 1 shows the bottom component (1) of the disposable shuttering, with the reliefs (9) for fixing the stiffening transverse separation elements (2).
Figure 2:
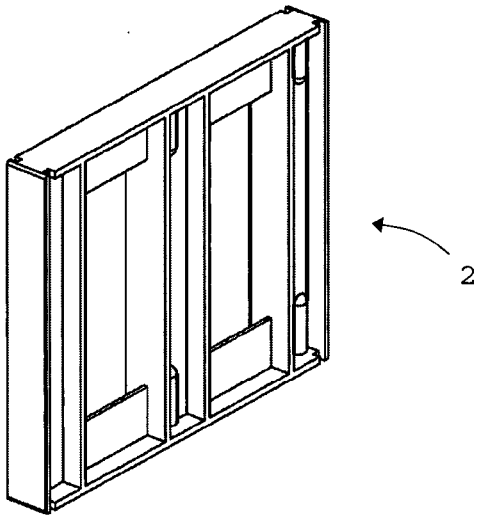
FIG. 2 shows stiffening means constituted by transverse separation elements (2) arranged inside the shuttering.
Figure 3:
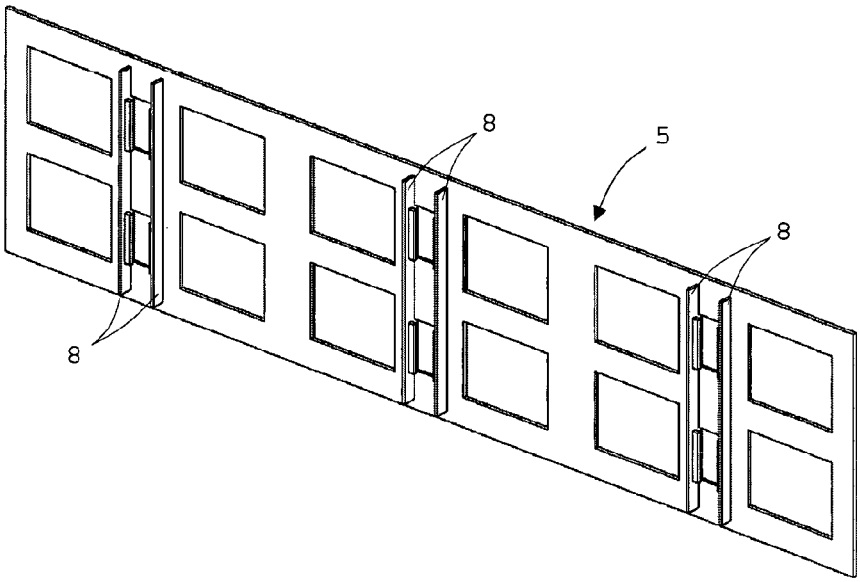
FIG. 3 shows the lateral side (5) with the reliefs (8) for fixing the stiffening transverse separation elements (2).
Figure 4:
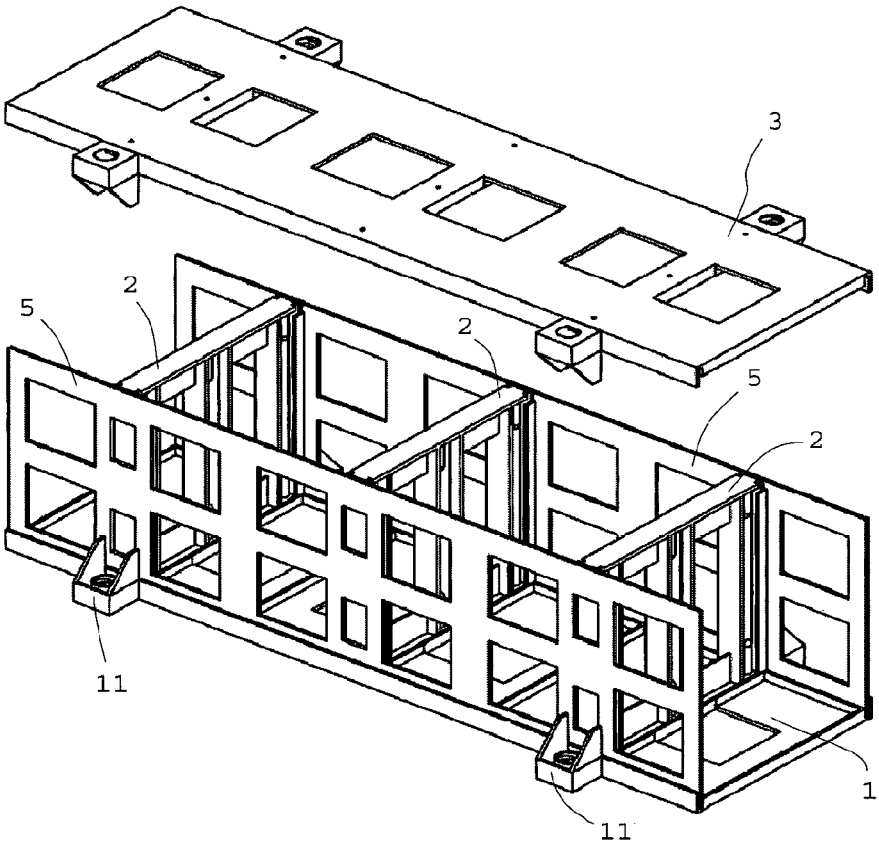
FIG. 4 shows a partly assembled shuttering.
Figure 5:
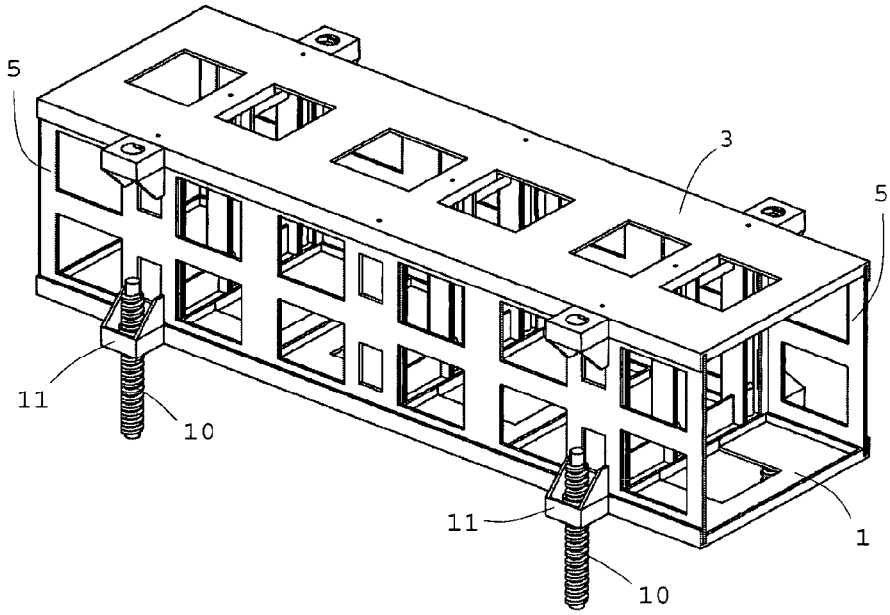
FIG. 5 shows an entirely assembled shuttering, with the means for adjusting the height and the planarity constituted by screws (10) directed to the trench, cooperating with nuts (11) integral with the assembled shuttering.
Figure 6:
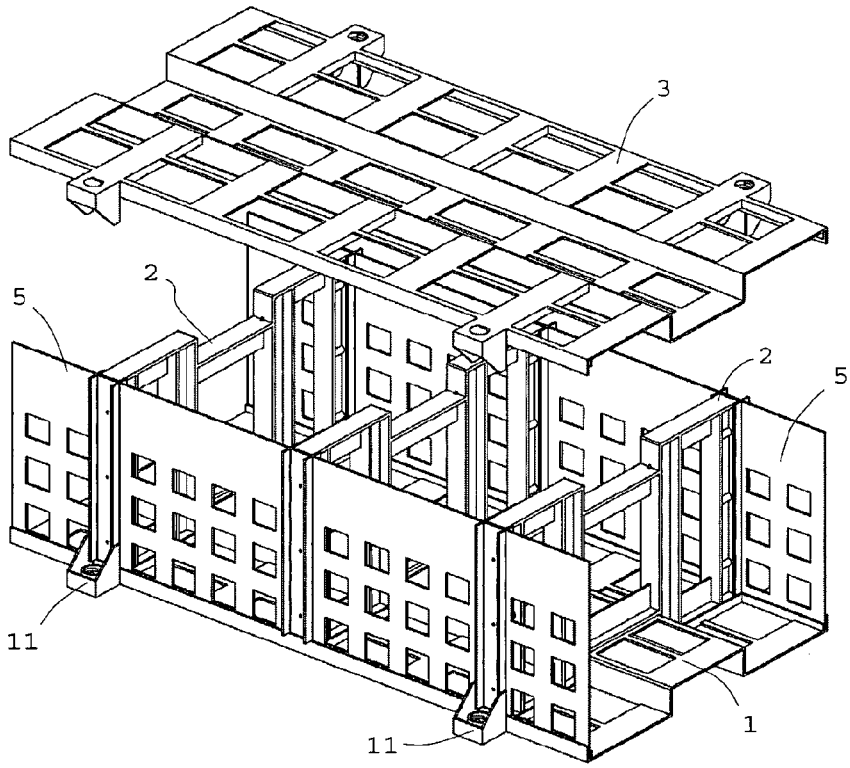
FIG. 6 shows a shuttering with said top piece (3) shaped in such a manner to obtain formworks having a top profile having means for receiving the bottom part of the walls in elevation.

The present invention regards an innovative shuttering of the type assemblable at the worksite, particularly suitable for constructing formworks for casting reinforced concrete foundations of the ground beam type.

In particular, the shuttering subject of the present invention allows obtaining a formwork and casting the foundation without requiring previously constructing the so-called "oversite concrete".

The shuttering subject of the present invention is substantially configured as the lateral surface of a parallelepiped having—on the lateral faces—a plurality of openings suitable to release, during the filling casting, a part of the cement mixture, so that the cement mixture completely fills the foundation trench.

In a particularly advantageous embodiment, the disposable shuttering subject of the present patent application comprises means for accurately defining the vertical position and the planarity, so as to obtain well aligned and substantially horizontal formworks.

According to a preferred implementation aspect of the present invention, said means for defining the vertical position and planarity are constituted by-screws (10) cooperating with nuts (11) integral with the assembled shuttering.

According to a preferred embodiment of the invention, the disposable shuttering subject of the present patent application is obtained starting from one or more moulded components made of plastic material, substantially planar-shaped.

In order to reduce the number of moulds, an advantageous embodiment provides for that the two moulded pieces used for the bottom (1) and for the top (3) be identical to each other and also that the pieces (5) used for the sides be identical to each other.

In an advantageous embodiment, the top piece (3) of the disposable shuttering subject of the present invention is shaped in a manner such to obtain formworks having a top profile provided with means for receiving the bottom part of the walls in elevation.

The invention claimed is:

1. Assemblable disposable shuttering for constructing modular formworks for shallow foundation castings, comprising a parallelepiped having moulded pieces made of substantially planar-shaped plastic material having a plurality of lateral faces with a plurality of openings suitable to release, during filling casting, a part of a cement mixture into a foundation trench, said moulded pieces made of substantially planar-shaped plastic material, said moulded pieces comprising side pieces (5), a bottom piece (1), and a top piece (3); stiffening means which are transverse separation elements (2) arranged inside said shuttering, wherein the interior surfaces of said side pieces, said bottom piece, and said top piece have reliefs (8, 9) for holding said transverse separation elements (2) in position, wherein said reliefs (8, 9) on each of said side pieces, said bottom piece, and said top piece are internally aligned with one another and comprise spaced-apart projections for holding said transverse separation elements (2) in position inside the shuttering; and means for defining the height and planarity of said shuttering in the foundation trench, wherein said means for defining the height and planarity are arranged in proximity to the corners of said shuttering, and wherein said means for defining the height and planarity are screws (10) directed to the trench, cooperating with nuts (11) integral with the assembled shuttering.

2. Assemblable disposable shuttering for constructing modular formworks, according to claim 1, wherein said bottom piece and top piece are identical to each other.

3. Assemblable disposable shuttering for constructing modular formworks, according to claim 1, wherein said side pieces are two and are identical to each other.

4. Assemblable disposable shuttering for constructing modular formworks, according to claim 1, wherein said moulded pieces made of substantially planar-shaped plastic material comprises said plurality of lateral faces, connected to each other by means of laminar hinges.

5. Assemblable disposable shuttering for constructing modular formworks, according to claim 1, wherein said moulded pieces made of substantially planar-shaped plastic material comprise connection means for keeping the shuttering assembled after mounting said shuttering.

6. Assemblable disposable shuttering for constructing modular formwork, according to claim 1, wherein said shuttering comprises means for reinforcing connection between said moulded pieces of shuttering, wherein said means are self-tapping screws, brackets, or hooks.

7. Assemblable disposable shuttering for constructing modular formworks, according to claim 1, wherein said top piece (3) is shaped with a top profile having means for receiving a bottom part of a wall.

* * * * *